US009541347B2

(12) United States Patent
Maugham

(10) Patent No.: US 9,541,347 B2
(45) Date of Patent: Jan. 10, 2017

(54) SHORT COLLAPSIBLE RIFLE STOCK

(71) Applicant: M.VB Industries, Inc, Deeflield Beach, FL (US)

(72) Inventor: Christopher M Maugham, Atlantis, FL (US)

(73) Assignee: M.VB INDUSTRIES, INC., Deerfield Beach, FL (US)

( * ) Notice: Subject to any disclaimer, the term of this patent is extended or adjusted under 35 U.S.C. 154(b) by 0 days.

(21) Appl. No.: 14/883,781

(22) Filed: Oct. 15, 2015

(65) Prior Publication Data

US 2016/0116249 A1 Apr. 28, 2016

Related U.S. Application Data

(60) Provisional application No. 62/067,011, filed on Oct. 22, 2014.

(51) Int. Cl.
*F41C 23/04* (2006.01)
*F41A 3/66* (2006.01)
*F41C 23/08* (2006.01)

(52) U.S. Cl.
CPC ..... *F41C 23/04* (2013.01); *F41C 23/08* (2013.01)

(58) Field of Classification Search
CPC ..... F41C 23/00; F41C 23/02; F41C 23/04; F41C 23/06; F41C 23/08; F41C 23/14; F41A 3/82; F41A 3/84
USPC ..... 42/71.01, 72, 73, 74
See application file for complete search history.

(56) References Cited

U.S. PATENT DOCUMENTS 3,137,958 A * 6/1964 Lewis ..... F41C 23/14 42/73
4,279,091 A * 7/1981 Edwards ..... F41C 23/06 42/1.06
4,355,563 A * 10/1982 Swieskowski ..... F41A 19/03 89/130
7,213,498 B1 * 5/2007 Davies ..... F41A 3/94 42/74
7,478,495 B1 * 1/2009 Alzamora ..... F41C 23/06 42/74
2006/0048637 A1 * 3/2006 Dimitrios ..... F41A 3/86 89/14.3
2008/0110074 A1 * 5/2008 Bucholtz ..... F41C 23/06 42/1.06
2010/0050492 A1 * 3/2010 Faifer ..... F41A 3/82 42/1.06

(Continued)

*Primary Examiner* — Bret Hayes

(57) ABSTRACT

A collapsible rifle stock which provides a significantly shorter and more compatible stock designs. The stock includes a recoil pad, a buffer tube assembly, a buffer-receiving cavity, a track, a locking mechanism, and a release mechanism. The buffer-receiving cavity traverses through the recoil pad to facilitate a short collapsed configuration for the stock. The track is adjacently connected to the recoil pad, oriented parallel to a central axis of the buffer-receiving cavity. The buffer tube assembly attaches the stock to the rifle. The buffer tube assembly is slidably engaged along the track to allow for relative movement. The locking mechanism in conjunction with the release mechanism allow the user to position the stock into a collapsed and an extended configuration. The locking mechanism is mechanically integrated in between the track and the buffer tube assembly. The release mechanism is mechanically integrated in between the track and the recoil pad.

10 Claims, 12 Drawing Sheets

(56) References Cited

U.S. PATENT DOCUMENTS

| | | | | |
|---|---|---|---|---|
| 2014/0190056 | A1* | 7/2014 | Troy | F41C 23/14<br>42/71.01 |
| 2014/0260946 | A1* | 9/2014 | Gomez | F41A 5/18<br>89/191.01 |
| 2016/0069636 | A1* | 3/2016 | Gomirato | F41C 23/14<br>42/73 |
| 2016/0097613 | A1* | 4/2016 | Lamb | F41C 23/22<br>42/71.01 |

* cited by examiner

SECTION A-A

DETAIL B

DETAIL B

SECTION A-A

SECTION A-A

SHORT COLLAPSIBLE RIFLE STOCK

The current application claims a priority to the U.S. Provisional Patent application Ser. No. 62/067,011 filed on Oct. 22, 2014.

FIELD OF THE INVENTION

The present invention relates generally to rifle accessories. More specifically, the present invention is a short collapsible stock that does not require the use of a specialized bolt carrier group.

BACKGROUND OF THE INVENTION

The popularity of the M4 and AR-15 rifle platforms is mainly due their highly customizable design, allowing user to construct and accessorize a rifle for specific missions, applications, or based on his or her personal preferences. A large number of manufacturers produce and sell aftermarket internal and external components for M4 and AR-15 rifle platforms, each offering specific features and benefits not seen in the traditional rifle design. This allows many owners to assemble rifles which reflect their personal needs and preferences.

One of the aspects which owners of M4 and AR-15 rifle platforms desire is a smaller and easier to store design. This aspect is sought after by the military, the police, and civilian owners of M4 and AR-15 rifles. The main way this aspect is achieved is through the use of collapsible stocks. Collapsible stocks provide a means for decreasing the overall length of the rifle in order to facilitate transport and storage. For the M4 and AR-15 rifle platforms, collapsible stocks had long been thought to have reached their minimum length. Recently some manufacturers have developed collapsible rifle stocks that are now significantly shorter than previously available. However, these products require the replacement of a component that the owners would prefer not to or cannot replace. This component is the bolt carrier. The bolt carrier is the main part of the bolt carrier group assembly which facilitates the extraction of the fired shell case and the loading of a fresh round into the firing chamber from the magazine. The bolt carrier greatly influences the reliability of the rifle, hence the resistance to changing the bolt carrier for shorter stock designs.

One of the main limiting factors for shortening the rifle stock is the minimum compressed length of a buffer spring. While combustion gases from the firing of the rifle drives the bolt carrier group rearward, the buffer spring becomes compressed behind it inside the buffer tube; the buffer tube is the replaceable, rearmost portion of the bore in which the bolt carrier group reciprocates. The compressed buffer spring then drives the bolt carrier group forward, reloading the chamber in preparation for firing the next round. The distance traveled by the bolt carrier group is actually the limiting factor for shortening the stock of a rifle. This limit is directly reflected in the minimum compressed length of the buffer spring. As mentioned above, one of the main ways that current designs achieve a shorter rifle stock is through the modification of the bolt carrier component. As this necessitates the exchange of the bolt carrier, the rifle owner must make the choice between the shorter stock and the preferred bolt carrier that they had previously purchased.

Additionally, the method of unlocking the mechanism for extending or collapsing these new short stocks has been placed on the fixed portion of the stock, which is a location significantly different from traditional designs, which operators have become accustomed.

The present invention is a collapsible stock which provides a means for selectively shortening the overall length of the rifle easily and efficiently without requiring the user to switch bolt carriers. Additionally, the present invention utilizes a release mechanism positioned on the butt pad portion of the stock.

DETAIL DESCRIPTIONS OF THE INVENTION

All illustrations of the drawings are for the purpose of describing selected versions of the present invention and are not intended to limit the scope of the present invention.

The present invention is generally related to the field of semi-automatic and automatic firearms. More specifically, the present invention is a rifle stock capable of being collapsed to a shortened length in order to facilitate storage and transportation. The present invention is disclosed in relation to the AR-15 and the M4 rifle platform. However, the scope of the present invention is not limited by the aforementioned applications; the present invention may be altered and adapted to fit alternative firearms.

Figure 1:
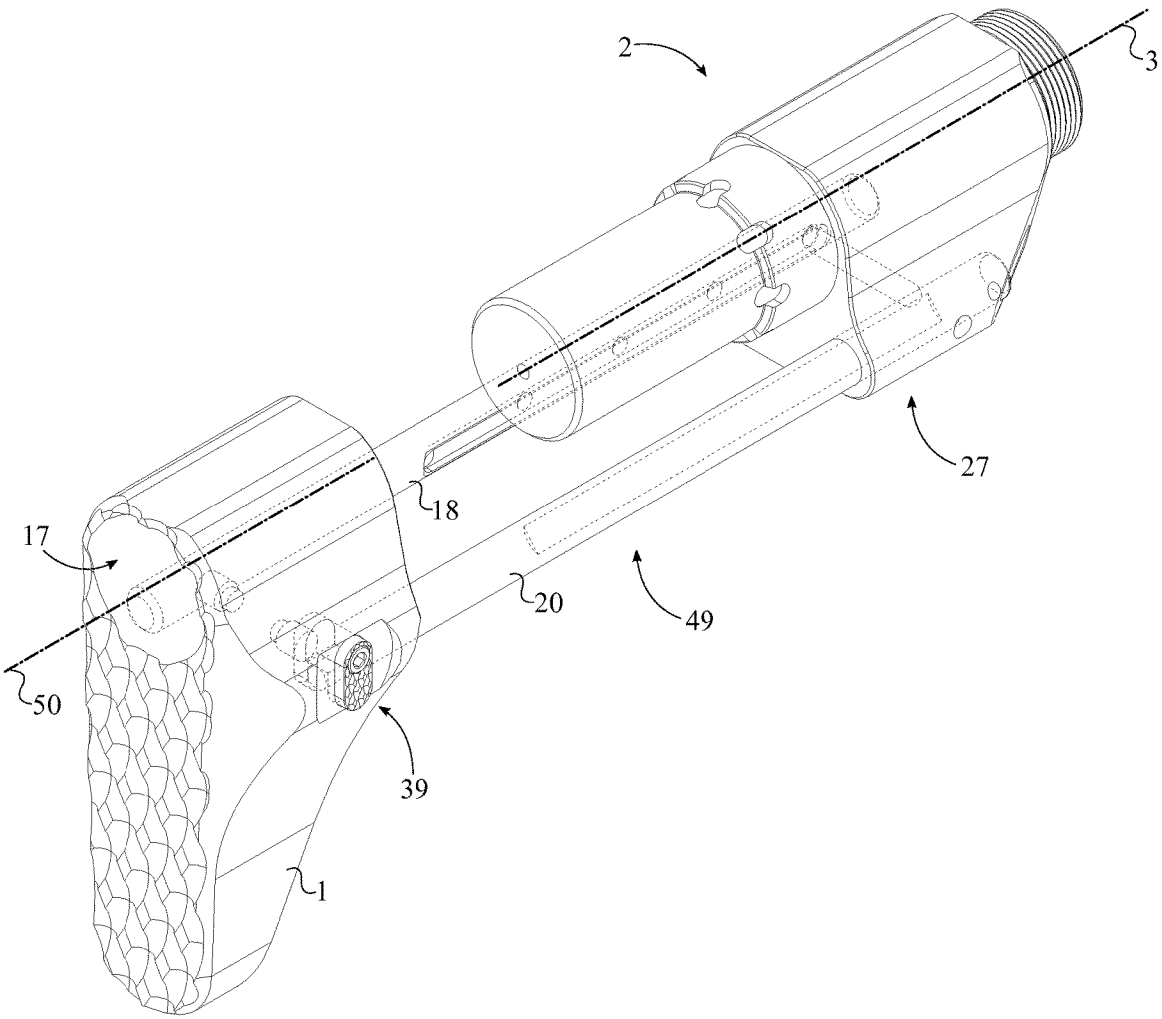
FIG. 1 is a perspective view of the present invention.
Figure 11:
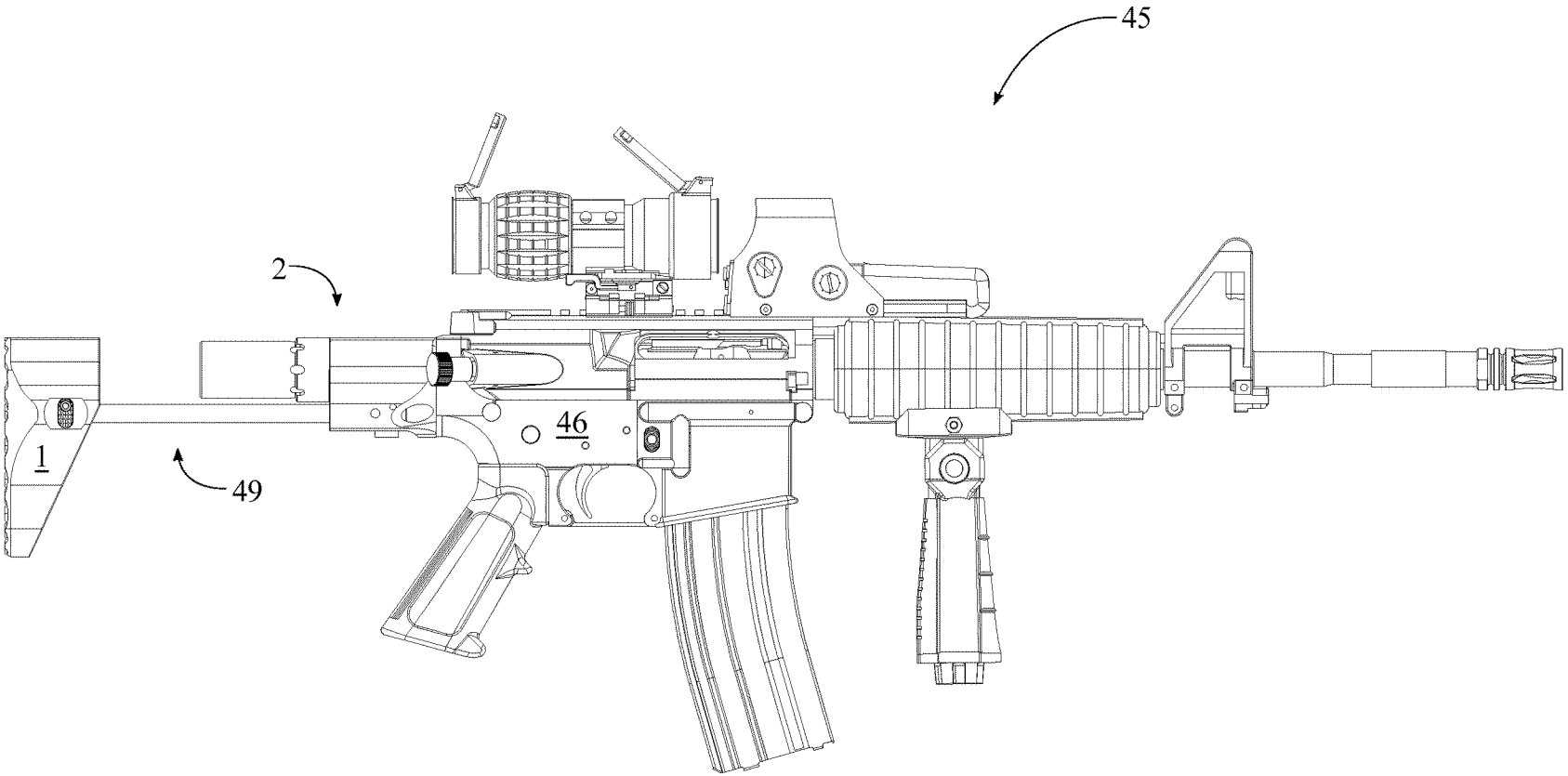
FIG. 11 is a side-view of the present invention attached to a rifle, positioned into the extended configuration.
Figure 12:
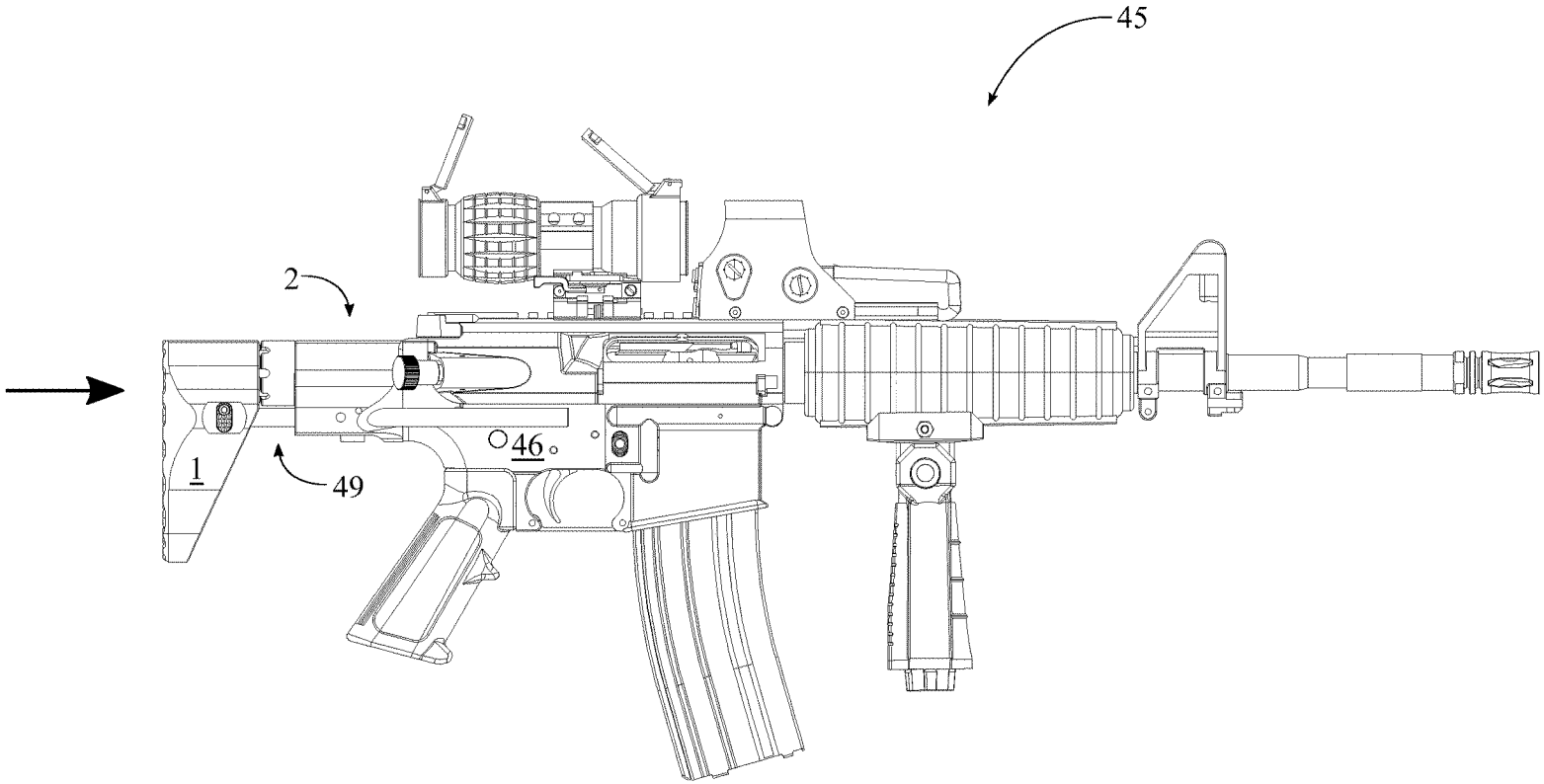
FIG. 12 is a side-view of the present invention attached to the rifle, positioned into the collapsed configuration.

Referring to FIG. 1, in the preferred embodiment, the present invention comprises a recoil pad 1, a buffer tube assembly 2, a buffer-receiving cavity 17, a track 49, a locking mechanism 27, and a release mechanism 39. The recoil pad 1 acts as a dampening mechanism for the user's shoulder as well as a stabilizing interface for the rifle 45, reducing the amount of recoil felt by the user while shooting the attached firearm; the recoil pad 1 may contain integrated buffer material which the user puts his or her shoulder on, materials such as rubber, foam, and leather to name a few non-limiting examples. Additionally, the recoil pad 1 prevents the slippage of the firearm on the user's clothing. Referring to FIG. 11 and FIG. 12, the buffer tube assembly 2 connects/attaches the present invention to a receiver 46 of a rifle 45 and houses/protects the components which provide the reciprocating force required for a bolt carrier group of the rifle 45. The buffer-receiving cavity 17 traverses through the recoil pad 1 and is shaped and seized to receive a portion of the buffer tube assembly 2. This allows the present invention to reach a significantly short length when positioned into a collapsed configuration. The track 49 slidably engages the buffer tube assembly 2 and the recoil pad 1 with each other, thus allowing the present invention to be positioned into the collapsed configuration as well as an extended configuration. The track 49 is adjacently connected to the recoil pad 1, oriented parallel to a central axis 50 of the buffer-receiving cavity 17. The buffer tube assembly 2 is slidably engaged along the track 49, allowing for relative movement between the buffer tube assembly 2 and the recoil pad 1 as seen in FIG. 11 and FIG. 12.

Figure 2:
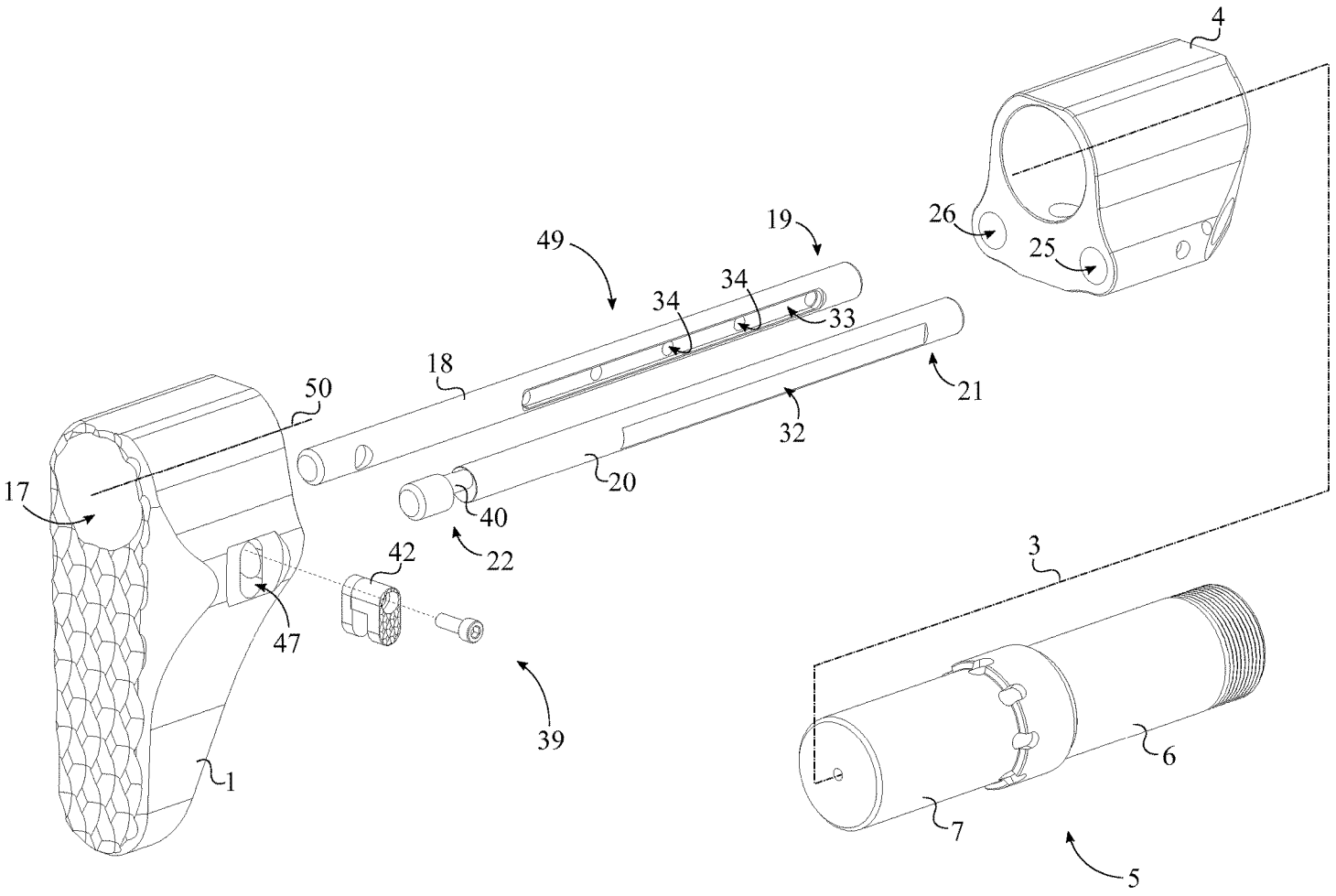
FIG. 2 is a partially exploded perspective view of the present invention.
Figure 6:
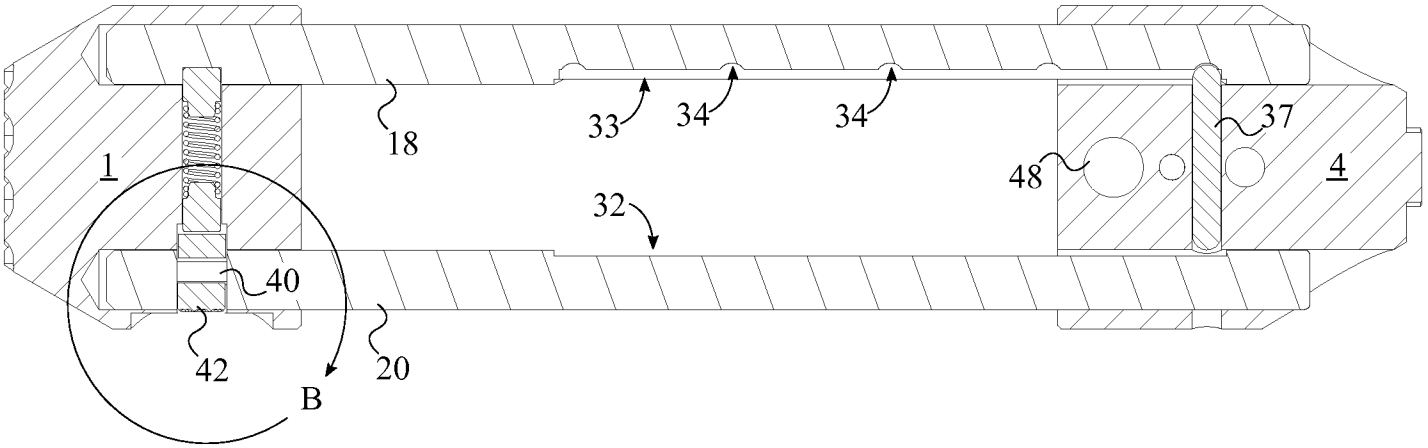
FIG. 6 is a sectional-cut view taken about line A-A in FIG. 5.

The locking mechanism 27 in conjunction with the release mechanism 39 allow the present invention to be positioned and secured in to the collapsed and extended configurations. The locking mechanism 27 allows the buffer tube assembly 2 to be secured to the track 49 at incremental points, thus preventing relative movement between the buffer tube assembly 2 and the recoil pad 1. To achieve this, the locking mechanism 27 is mechanically integrated in between the track 49 and the buffer tube assembly 2 as seen in FIG. 1 and FIG. 2. The release mechanism 39 releases/actuates the locking mechanism 27 in order to allow the buffer tube assembly 2 to slide along the track 49. Referring to FIG. 6, the release mechanism 39 is mechanically integrated in between the track 49 and the recoil pad 1.

Figure 3:
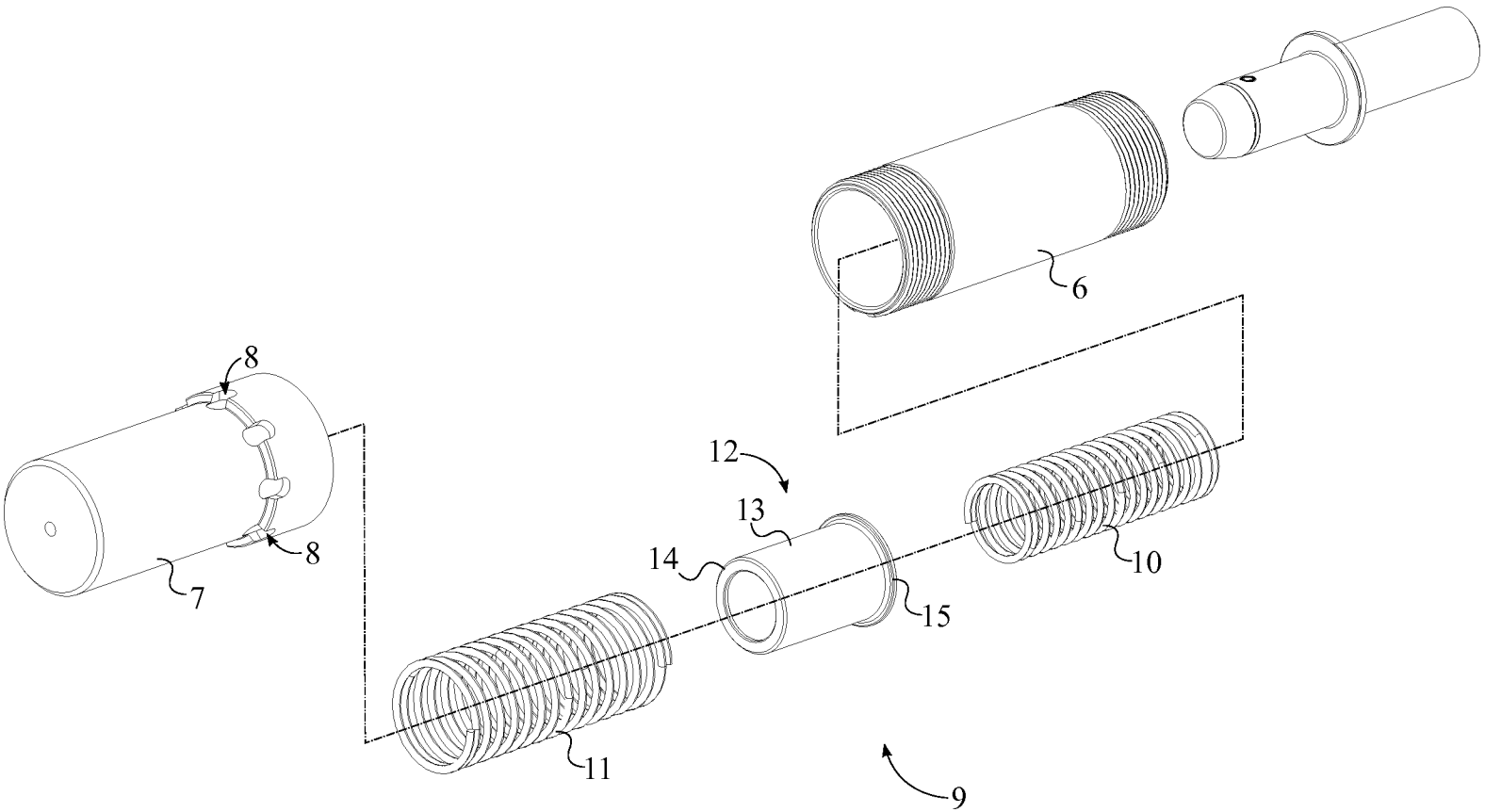
FIG. 3 is an exploded view of the buffer tube and the spring assembly.

Referring to FIGS. 1-3, the buffer tube assembly 2 comprises a spring assembly 9, a buffer tube 5, and a tubular stock base 4. The spring assembly 9 is concentrically positioned within the buffer tube 5 and provides the recoil-spring pressure required for the bolt carrier assembly in order to eject a fired cartridge and chamber the following cartridge. The buffer tube 5 houses the spring assembly 9 and attaches the present invention to the receiver 46 of the rifle 45. A plurality of recessions 8 is used to aid the user in attaching the buffer tube 5 to the receiver 46. The plurality of recessions 8 is radially and externally distributed about the buffer tube 5 with each of the plurality of recessions 8 laterally traversing into the buffer tube 5 to yield a receiving region for a torque tool. The torque tool applies a torque on to the buffer tube 5 through the plurality of recessions 8 in order to attach the buffer tube 5 to the receiver 46. The buffer tube 5 is concentrically positioned within and removable attached to the tubular stock base 4. More specifically, a central axis 3 of the buffer tube 5 is positioned along the axis of the buffer-receiving cavity 17 to ensure that in the collapsed configuration a portion of the buffer tube 5 is situated within the buffer-receiving cavity 17 as seen in FIG. 12. In the preferred embodiment, the buffer tube 5 may be removed from the tubular stock base 4 through the release of an engagement mechanism located on the bottom of the tubular stock base 4. The preferred engagement mechanism is a retaining pin in conjunction with a receiving slot. The receiving slot traverses through the tubular stock base 4 and partially into the buffer tube 5. The retaining pin is positioned within the receiving slot and held in place through a spring lock, pushing on the retaining pin toggles the engagement mechanism between locked and unlocked. Alternative engagement mechanisms may be utilized instead as well. The tubular stock base 4 is the intermediate component which couples the track 49 to the buffer tube 5. More specifically, the tubular stock base 4 is slidably engaged to the track 49 and removably attached to the buffer tube 5. This configuration allows the relative motion between the rifle 45 and the recoil pad 1. Integrated into the bottom portion of the tubular stock base 4 is a sling mount 48. The sling mount 48 allows for the user to attach a standard sling to the tubular stock base 4 and therefore the present invention.

The minimum length of current collapsible stocks is limited by the minimal compression length of the buffer spring. The minimal compression length is directly dependent on the required travel distance of the bolt carrier group. Current designs utilize a single spring in conjunction with a custom bolt carrier to achieve this criteria while simultaneously reducing the overall length of the collapsible stock. Alternatively, the present invention utilizes the spring assembly 9 comprising a spring adaptor 12, an inner spring 10, and an outer spring 11 in order to allow the bolt carrier group to have the same amount of travel when reciprocating but take up half the length of modern single buffer springs in the compressed state. This is because when the spring assembly 9 is compressed, the inner spring 10 is nested within the outer spring 11 through the spring adaptor 12. This design ensures that the present invention is compatible with the majority of existing bolt carrier groups and does not require the user to obtain a custom bolt carrier group.

Figure 4:
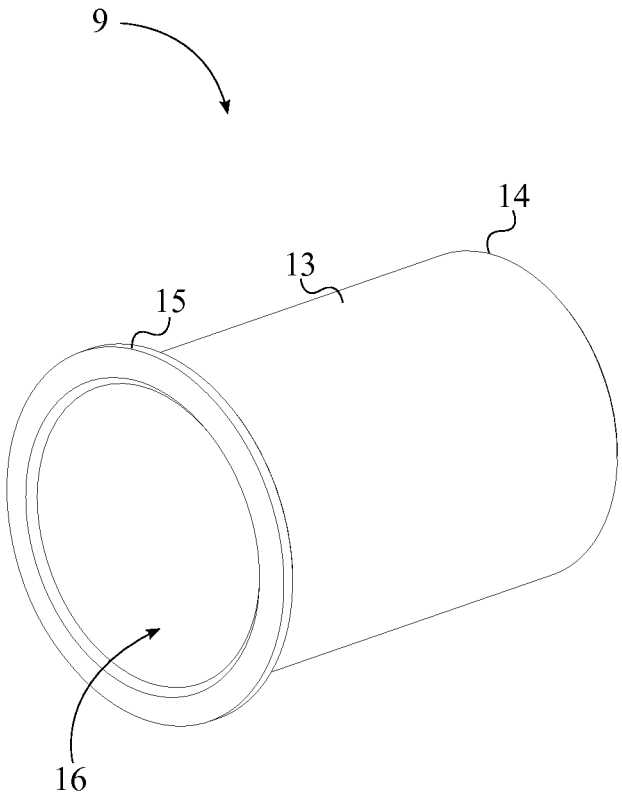
FIG. 4 is a perspective view of the spring adaptor of the spring assembly.
Figure 5:
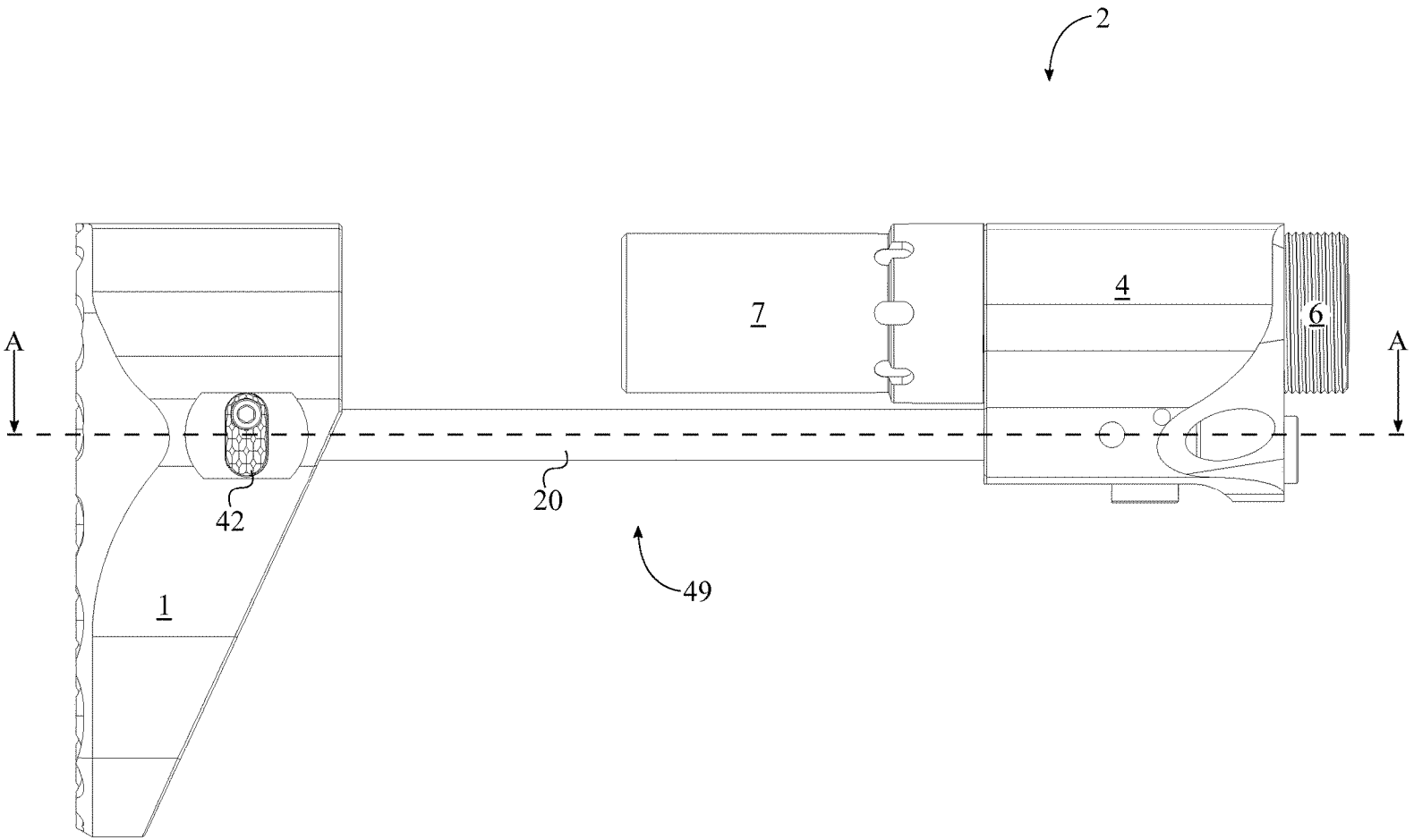
FIG. 5 is a right-side view of the present invention.

Referring to FIG. 4 and FIG. 5, the spring adaptor 12 comprises a cylindrical body 13, a support lip 15, and a spring-receiving cavity 16. The spring-receiving cavity 16 traverses into the cylindrical body 13 along a central axis of the cylindrical body 13 and is sized/shaped to receive the inner spring 10. The support lip 15 provides a lateral wall upon which the outer spring 11 may be pressed against. The support lip 15 is positioned opposite a first edge 14 of the cylindrical body 13, across the cylindrical body 13. Additionally, the support lip 15 is externally and annularly connected to the cylindrical body 13 with a thickness that is equal or greater than the thickness of the outer spring 11. The inner spring 10 is sized and shaped to the parameters of the spring-receiving cavity 16 and is concentrically positioned within the spring-receiving cavity 16. The outer spring 11 is sized and shaped to the outer surface of the cylindrical body 13 and is concentrically positioned about the cylindrical body 13, being pressed against the support lip 15. This configures the inner spring 10 and the outer spring 11 along the same axis, coupled together in series through the spring adaptor 12. The inner spring 10 and the outer spring 11 are each configured to yield a spring constant that when combined together in series meet the requirements set by the bolt carrier group of the rifle 45.

Referring to FIG. 2 and FIG. 3, the buffer tube 5 comprises a receiver-engaging tube 6 and a supporting tube 7. The receiver-engaging tube 6 connects the buffer tube 5 to the receiver 46 of the rifle 45 and as such is sized to fit within the stock receptive of the receiver 46. More specifically the receiver-engaging tube 6 is removably attached to the receiver 46 through a female-male threaded connection point with the receiver 46 being positioned opposite the supporting tube 7. Additionally, the receiver-engaging tube 6 is removably attached to the supporting tube 7. The supporting tube 7 provides a backing upon which the spring assembly 9 presses on. In particular, the receiver-engaging tube 6 is adjacently positioned to the supporting tube 7, opposite the buffer-receiving cavity 17, and is removable attached to the supporting tube 7 through a female-male threaded connection point.

Referring to FIG. 2, in the preferred embodiment of the present invention, the track 49 comprises a fixed bar 18 and a pivot bar 20. The pivot bar 20 is pivotably connected to the recoil pad 1 while the fixed bar 18 is adjacently connected to the recoil pad 1. Additionally, connected to the track 49 is the tubular stock base 4. More specifically, the tubular stock base 4 is slidably engaged to pivot bar 20 and the fixed bar 18 through a first cavity 25 and a second cavity 26, respectively. The first cavity 25 and the second cavity 26 each traverse through the tubular stock base 4, oriented parallel to a central axis 3 of the buffer tube assembly 2 as seen in FIG. 2. The first cavity 25 is shaped and sized to receive the pivot bar 20. Similarly, the second cavity 26 is shaped and sized to receive the fixed bar 18. The first cavity 25 and the second cavity 26 are also oriented parallel and offset to each other. This positions the first cavity 25 and the second cavity 26 on either side of the tubular stock base 4. The offset distance between the first cavity 25 and the second cavity 26 is dictated and defined by the width of the receiver 46 so as clear the sides of the receiver 46 when the present invention is positioned into the collapsed configuration, as seen in FIG. 12. The pivot bar 20 and the fixed bar 18 are further oriented parallel and offset to each other in order to align with the first cavity 25 and the second cavity 26, respectively. In particular, the pivot bar 20 is slidably positioned within the first cavity 25 and the fixed bar 18 is slidably positioned within the second cavity 26 in order to allow linear translation of the tubular stock base 4, and therefore the buffer tube assembly 2, towards or away from the recoil pad 1.

Figure 9:
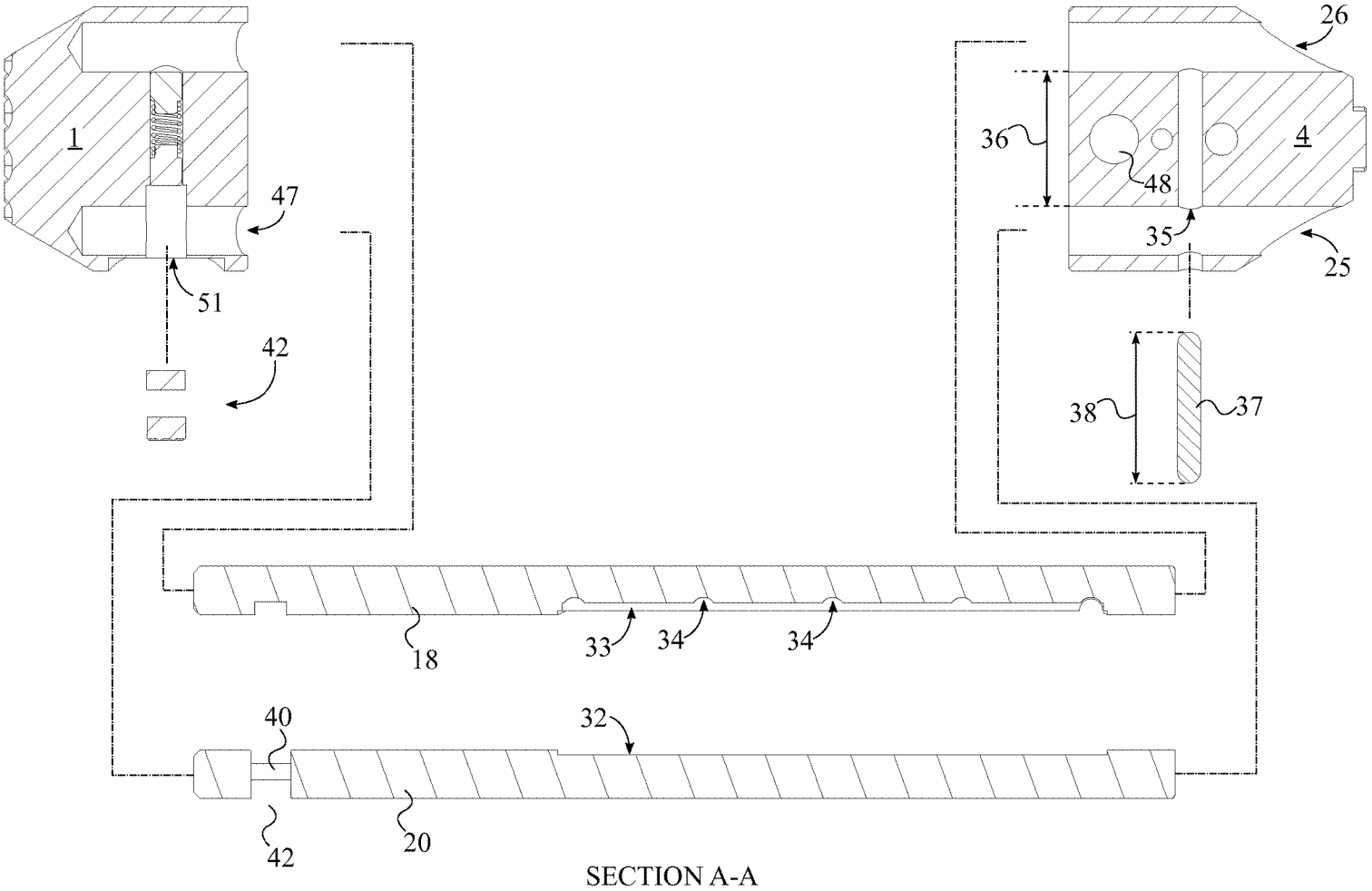
FIG. 9 is an exploded sectional-cut view taken about line A-A in FIG. 5.

Referring to FIG. 6 and FIG. 9, in the preferred embodiment of the present invention, the locking mechanism 27 is a variation on a pin-slot locking mechanism and is mechanically integrated in between the track 49 and the buffer tube assembly 2. More specifically, the locking mechanism 27 comprises a first channel 32, a second channel 33, a plurality of indentations 34, a detent hole 35, and a locking pin 37. The first channel 32 in conjunction with the rotational characteristic of the pivot bar 20 provide a means for laterally translating the locking pin 37. The first channel 32 laterally traverses into the pivot bar 20, adjacent to a first end 21 of the pivot bar 20. The second channel 33 laterally traverses into the fixed bar 18, adjacent to a first end 19 of the fixed bar 18, and prevents the fixed bar 18 from being accidentally dislodged from the second cavity 26. Both the first channel 32 and the second channel 33 are of a rectangular shape with the same length, width, and depth as seen in FIG. 2 and FIG. 9. The plurality of indentations 34 provides a multitude of recessed regions to which the locking pin 37 may be positioned into, thus locking the present invention into a specific configuration. Each configuration is defined by the length between the buffer tube assembly 2 and the recoil pad 1. Each of the plurality of indentations 34 laterally traverses into the fixed bar 18 from the second channel 33 and is of a circular shape so as to compliment the design of the locking pin 37. The plurality of indentations 34 is distributed along the second channel 33 at incremental lengths to provide the user with a multitude of locking configurations. The detent hole 35 laterally traverses through the tubular stock base 4 from the first cavity 25 to the second cavity 26 as seen in FIG. 9. A diameter of the detent hole 35 is equal to a diameter of the locking pin 37. The locking pin 37 is slidably positioned within the detent hole 35 and mechanically locks the tubular stock base 4 and the fixed bar 18 to each other. The two components are locked together when the locking pin 37 is selectively engaged with one of the plurality of indentations 34 through the second channel 33.

Referring to FIG. 9, a length 38 of the locking pin 37 is greater than a length 36 of the detent hole 35. This constraint is key for the locking mechanism 27. In the locked state, the pivot bar 20 is radially positioned such that the first channel 32 does not overlap with the detent hole 35 resulting in the outer surface of the pivot bar 20 pressing against the locking pin 37. This forces the locking pin 37 to engage a specific indentation of the plurality of indentations 34. The actuation motion which controls and releases the locking mechanism 27 is the rotation of the pivot bar 20. In the preferred embodiment of the present invention, this actuation motion is performed by the release mechanism 39. The release mechanism 39 rotates the pivot bar 20 such that the first channel 32 aligns with the detent hole 35, as seen in FIG. 6, and thus releasing the locking pin 37 from the specific indentation. More specifically, the locking pin 37 may be partially moved inside the first channel 32 which in turn disengages the locking pin 37 from the specific indentation. This releases the locking mechanism 27 and allows the fixed bar 18 and the attached components to move relative to the buffer tube assembly 2, allowing the present invention to be positioned into the collapsed configuration or the extended configuration. Referring to FIG. 11, in the collapsed configuration, the recoil pad 1 is positioned directly adjacent to the buffer tube assembly 2 with the locking pin 37 being engaged to the indentation from the plurality of indentations 34 which is furthest away from the first end 19 of the fixed bar 18. Referring to FIG. 12, in the extended configuration, the recoil pad 1 is positioned at the furthermost distance from the buffer tube assembly 2 with the locking pin 37 being engaged to the indentation from the plurality of indentations 34 that is closest to the first end 19 of the fixed bar 18.

Figure 7:
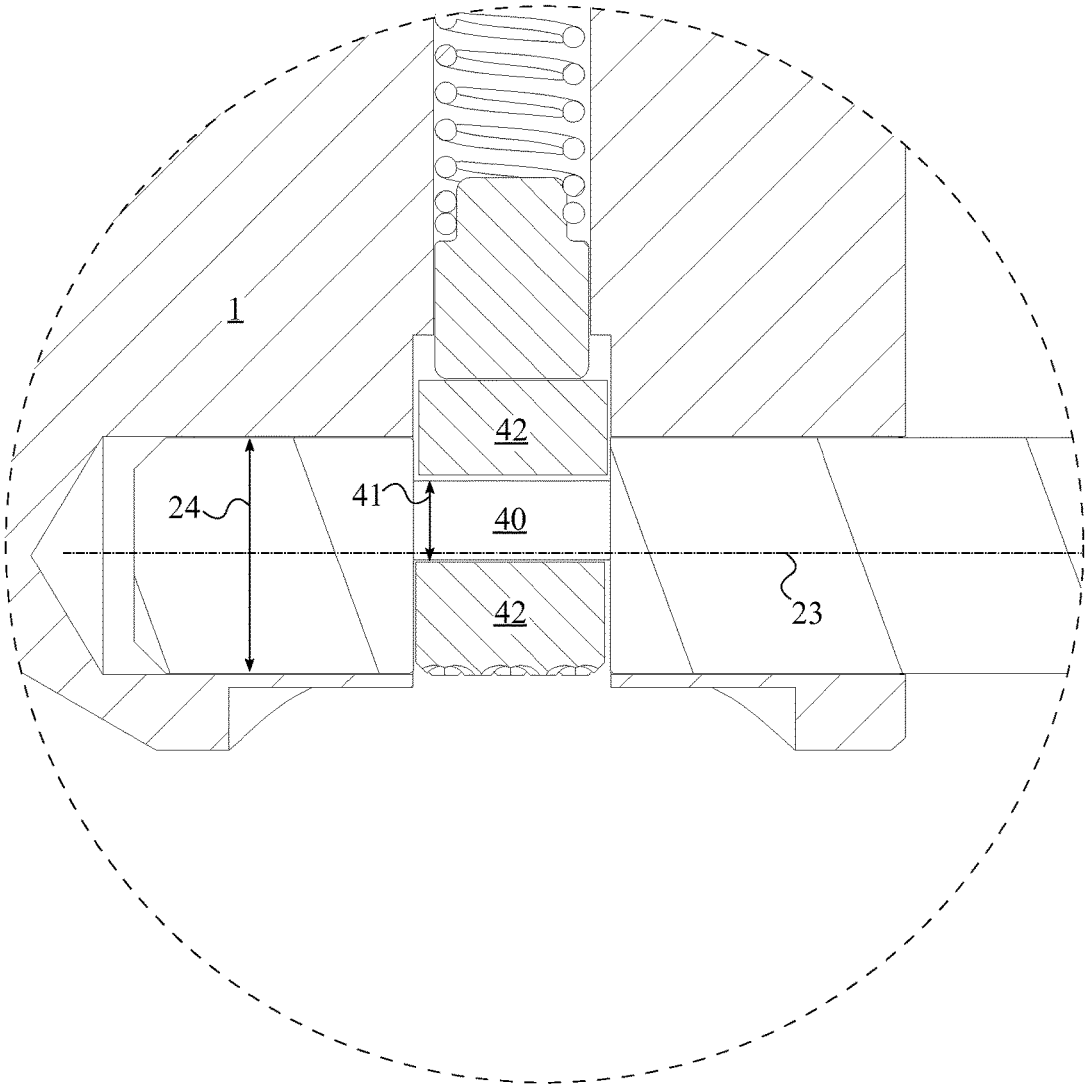
FIG. 7 is a detailed view taken about circle B in FIG. 6.
Figure 8:
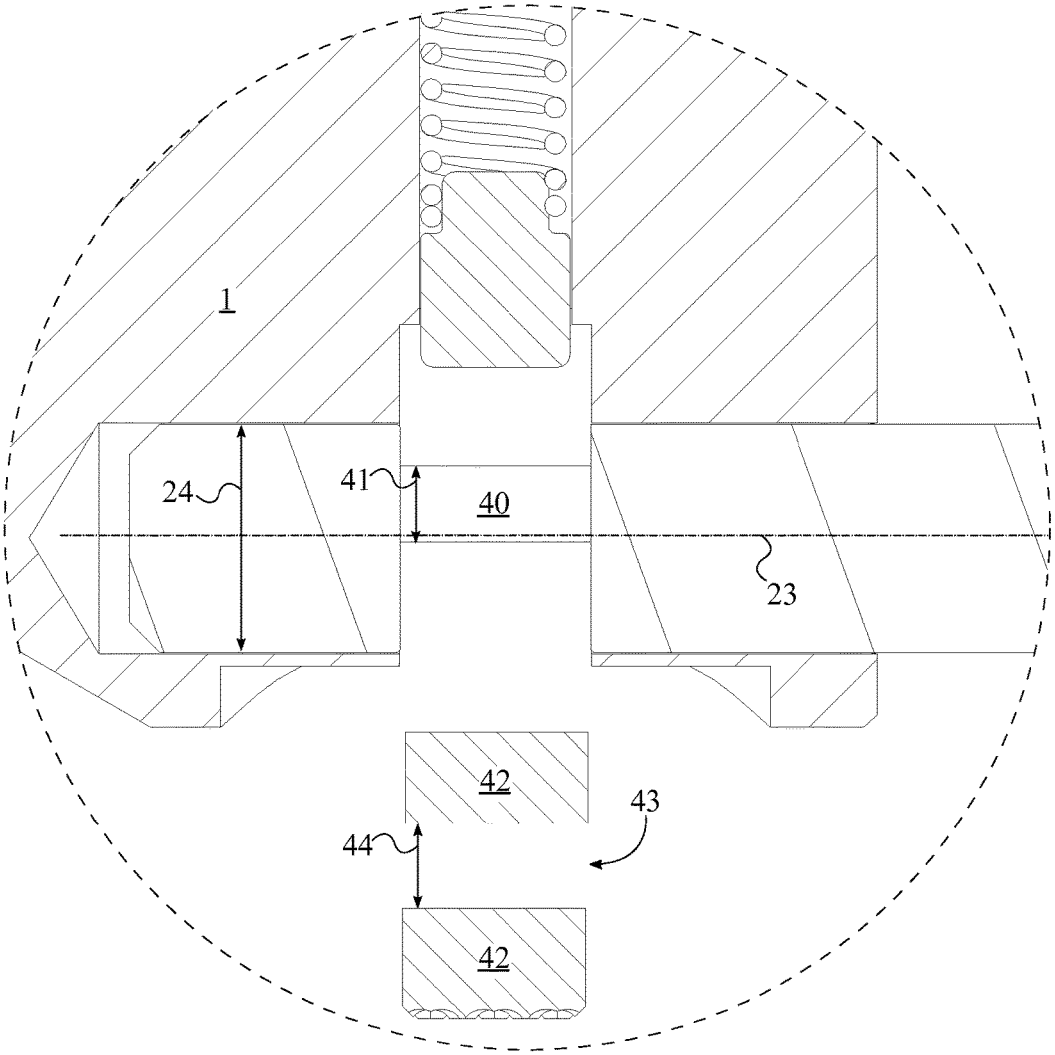
FIG. 8 is a detailed view take about circle B in FIG. 6 with the U-shaped button positioned in an exploded state.

In the preferred embodiment of the present invention, the release mechanism 39 comprises a crankpin 40, a U-shaped button 42, and a button-receiving cavity 51. Traditional release mechanisms are usually integrated to the front portion of the stock. This requires the user to actuate the release mechanism 39 on the non-moving part of the stock, a location significantly different from that which users have become accustomed to. The present invention integrates the release mechanism 39 into the recoil pad 1 as this is design is more convenient to the end user. As described above, the pivot bar 20 is rotatably connected to the recoil pad 1. This is achieved through a bore 47. The bore 47 is concentrically aligned with the first cavity 25 and traverses into the recoil pad 1. The bore 47 is sized to receive the pivot bar 20. More specifically, a second end 22 of the pivot bar 20 is rotatably positioned within the bore 47 as seen in FIG. 9. The crankpin 40 in conjunction with the U-shaped button 42 convert linear motion into rotational motion in order to rotate the pivot bar 20 and actuates the locking mechanism 27. Referring to FIG. 7 and FIG. 8, the crankpin 40 is adjacently connected to the second end 22 of the pivot bar 20, oriented parallel to the pivot bar 20. The crankpin 40 is positioned eccentrically from a main axis 23 of the pivot bar 20 with a diameter that is smaller than a diameter 24 of the pivot bar 20 in order to convert linear motion into rotational motion. The button-receiving cavity 51 houses the U-shaped button 42 and as such is shaped/sized to receive the U-shaped button 42. The button-receiving cavity 51 is positioned adjacent to the bore 47 and laterally traverses into the recoil pad 1, perpendicularly intersecting the bore 47. The pivot bar 20 is positioned within the bore 47 such that the crankpin 40 is positioned within the bore and the button-receiving cavity 51 as seen in FIG. 8.

The U-shaped button 42 is tensionally mounted within the button-receiving cavity 51 through a spring detent and the crankpin 40. Referring to FIGS. 6-8, the U-shaped button 42 is positioned within the button-receiving cavity 51 such that the crankpin 40 is located within a receiving-channel 43 of the U-shaped button 42, thus retaining the U-shaped button 42 within the button-receiving cavity 51; for this design a width 44 of the receiving-channel 43 must be larger than the diameter 41 of the crankpin 40. The spring detent provides the reciprocating force in order to return the U-shaped button 42 and the release mechanism 39 to a pre-set configuration. The pre-set configuration is associated with the locked position of the locking mechanism 27, wherein the pivot bar 20 is radially positioned such that the first channel 32 offset from the detent hole 35. The spring detent is integrated adjacent and normal to the U-shaped button 42 such that a constant force is applied on the U-shaped button 42. For the user to utilize the release mechanism 39, he or she simply needs to push the U-shaped button 42 into the recoil pad 1. This linear translation causes the crankpin 40 to rotate the pivot bar 20, causing the locking pin 37 to disengage the specific indentation, thus allowing the fixed bar 18 to slide within the second cavity 26. The user then slides the recoil pad 1 and the track 49 relative to the buffer tube assembly 2 into the desired configuration. Once the U-shaped button 42 is released, the spring detent applies a pushing force on the U-shaped button 42, thus applying a force in order to return the locking mechanism 27 to the pre-set configuration. At this point, the locking pin 37 is be forced into the next indention from the plurality of indentation 34 which it passes, thus engaging the locking mechanism 27. The scope of the present invention is not limited by the aforementioned release mechanism 39. Alternative designs and mechanisms may be utilized for the release mechanism 39. For example, in one embodiment a lever may be integrated into the pivot bar 20 which allows the user to engage or disengage the locking mechanism 27.

Figure 10:
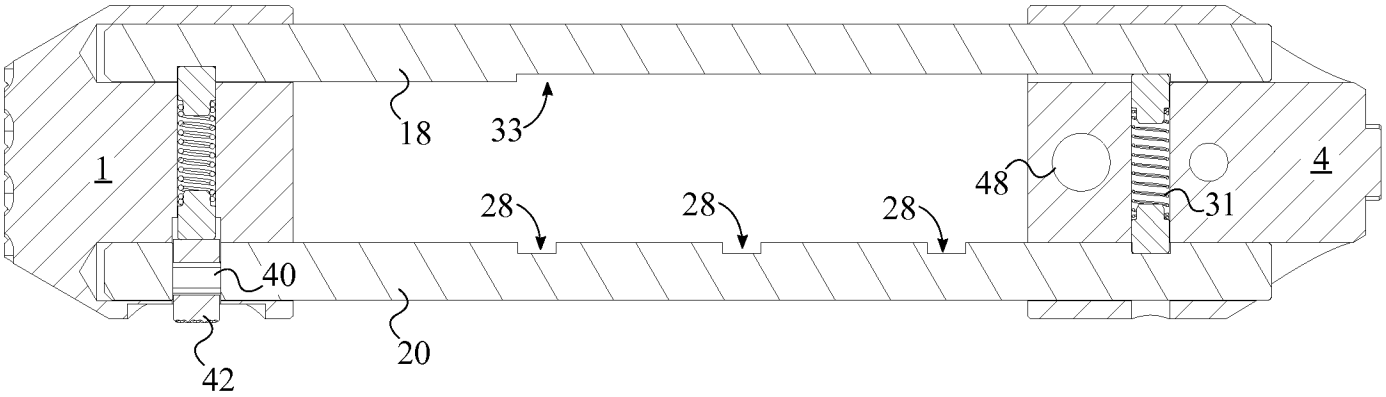
FIG. 10 is a sectional-cut view taken about line A-A in FIG. 5, depicting an alternative locking mechanism.

Referring to FIG. 10, in an alternative embodiment of the present invention, the locking mechanism 27 comprises a plurality of locking slots 28, a spring-loaded detent 31, and the detent hole 35 as described above. The locking mechanism 27 also utilizes the second channel 33 as described above without the plurality of indentations 34. The spring-loaded detent 31 is positioned within the detent hole 35, pressing against the pivot bar 20 on one end and positioned within the second channel 33 on the other end. The spring-loaded detent 31 prevents the fixed bar 18 from being dislodged from the second cavity 26 by being continuously positioned within the second channel 33. The preferred spring-loaded detent 31 includes an engagement pin on either side of the spring. One engagement pin is positioned to engage the second channel 33 while the other engagement pin is positioned adjacent to the pivot bar 20. The plurality of locking slots 28 is distributed along the pivot bar 20, adjacent to the first end 21 of the pivot bar 20, and provide a multitude of recessed regions into which the spring-loaded detent 31 may be positioned. Each of the plurality of locking slots 28 laterally traverses into the pivot bar 20 and each is shaped to compliment the spring-loaded detent 31. In the locked configuration, the spring-loaded detent 31 is selectively engaged with one of the plurality of locking slots 28 as seen in FIG. 10. When the release mechanism 39 is actuated, the spring-loaded detent 31 is disengaged from a specific slot of the plurality of slots and allows the fixed bar 18 and the pivot bar 20 to slide within the second cavity 26 and the first cavity 25, respectively. To engage the locking mechanism 27, the user only needs to simply release the U-shaped button 42 and the spring-loaded detent 31 will snap into the next slot of the plurality of slots that it passes by.

Although the invention has been explained in relation to its preferred embodiment, it is to be understood that many other possible modifications and variations can be made without departing from the spirit and scope of the invention as hereinafter claimed.

What is claimed is:

1. A short collapsible rifle stock comprises:
- a recoil pad;
- a buffer tube assembly;
- a buffer-receiving cavity;
- a track;
- a locking mechanism;
- a release mechanism;
- the buffer-receiving cavity traversing through the recoil pad:
- the track being oriented parallel to a central axis of the buffer-receiving cavity;
- the track being adjacently connected to the recoil pad;
- the buffer tube assembly being slidably engaged along the track;
- the locking mechanism being mounted on the buffer tube assembly and interacting with the track;
- the release mechanism being mounted on the recoil pad and interacting with the track;
- the buffer tube assembly comprises a tubular stock base, a buffer tube, and a spring assembly;
- the spring assembly being concentrically positioned within the buffer tube;
- the buffer tube being concentrically positioned within the tubular stock base;
- the buffer tube being removably attached to the tubular stock base;
- a central axis of the buffer tube being positioned along the central axis of the buffer-receiving cavity;
- a plurality of recessions;
- the plurality of recessions being radially and externally distributed about the buffer tube; and
- each of the plurality of recessions laterally traversing into the buffer tube.

2. The short collapsible rifle stock as claimed in claim 1 comprises:
- the spring assembly comprises an inner spring, an outer spring, and a spring adaptor;
- the spring adaptor comprises a cylindrical body, a support lip, and a spring-receiving cavity;
- the spring-receiving cavity traversing into the cylindrical body;
- the support lip being positioned opposite a first edge of the cylindrical body, across the cylindrical body;
- the support lip being externally and annularly connected to the cylindrical body;
- the inner spring being concentrically positioned within the spring-receiving cavity;
- the outer spring being concentrically positioned about the cylindrical body; and
- the outer spring being pressed against the support lip.

3. The short collapsible rifle stock as claimed in claim 1 comprises:
- the buffer tube comprises a receiver-engaging tube and a supporting tube;
- the receiver-engaging tube being concentrically aligned to the supporting tube;
- the receiver-engaging tube being adjacently positioned to the supporting tube, opposite the buffer-receiving cavity; and
- the receiver-engaging tube being removably attached to the supporting tube.

4. The short collapsible rifle stock as claimed in claim 3 comprises:
- a receiver of a rifle; and
- the receiver being removably attached to the receiver-engaging tube, opposite the supporting tube.

5. The short collapsible rifle stock as claimed in claim 1 comprises:

a first cavity;

a second cavity;

the track comprises a fixed bar and a pivot bar;

the pivot bar being pivotably connected to the recoil pad;

the fixed bar being adjacently connected to the recoil pad;

the fixed bar and the pivot bar being oriented parallel and offset to each other;

the first cavity and the second cavity each traversing through the tubular stock base of the buffer tube assembly, parallel to a central axis of the buffer tube assembly;

the first cavity and the second cavity being oriented parallel and offset to each other;

the pivot bar being slidably positioned within the first cavity; and the fixed bar being slidably positioned within the second cavity.

6. The short collapsible rifle stock as claimed in claim 1 comprises:

the locking mechanism comprises a plurality of locking slots, a detent hole, and a spring-loaded detent;

the detent hole laterally traversing through the tubular stock base of the buffer tube assembly from a first cavity to a second cavity, the first cavity and the second cavity each traversing through the tubular stock base;

the plurality of locking slots being distributed along a pivot bar of the track, adjacent to a first end of the pivot bar;

each of the plurality of locking slots laterally traversing into the pivot bar;

the spring-loaded detent being positioned within the detent hole; and the spring-loaded detent being selectively engaged with one of the plurality of locking slots.

7. The short collapsible rifle stock as claimed in claim 1 comprises:

the locking mechanism comprises a first channel, a second channel, a plurality of indentations, a detent hole, and a locking pin;

the detent hole laterally traversing through the tubular stock base of the buffer tube assembly from a first cavity to a second cavity, the first cavity and the second cavity each traversing through the tubular stock base;

the locking pin being slidably positioned within the detent hole;

the first channel laterally traversing into a pivot bar of the track, adjacent to a first end of the pivot bar;

the second channel laterally traversing into a fixed bar of the track, adjacent to a first end of the fixed bar;

each of the plurality of indentations laterally traversing into the fixed bar from the second channel;

the plurality of indentations being distributed along the second channel; and the locking pin being selectively engaged with one of the plurality of indentations through the second channel.

8. The short collapsible rifle stock as claimed in claim 7, wherein a length of the locking pin is greater than a length of the detent hole.

9. The short collapsible rifle stock as claimed in claim 1 comprises:

a bore;

the bore being concentrically aligned with a first cavity, the first cavity being traversing through the tubular stock base;

the bore traversing into the recoil pad;

a second end of a pivot bar of the track being rotatably positioned within the bore;

the release mechanism comprises a crankpin, a U-shaped button, and a button-receiving cavity;

the crankpin being adjacently connected to the second end of the pivot bar, oriented parallel to the pivot bar;

the crankpin being positioned eccentrically from a main axis of the pivot bar;

a diameter of the crankpin being smaller than a diameter of the pivot bar;

the button-receiving cavity being positioned adjacent to the bore;

the button-receiving cavity laterally traversing into the recoil pad, perpendicularly intersecting the bore;

the crankpin being positioned within the bore and the button-receiving cavity;

the U-shaped button being tensionally mounted within the button-receiving cavity;

the crankpin being positioned within a receiving-channel of the U-shaped button; and a width of the receiving-channel being larger than the diameter of the crankpin.

10. The short collapsible rifle stock as claimed in claim 1 comprises:

a sling mount; and the sling mount being integrated into the tubular stock base.

* * * * *